US008590645B2

(12) United States Patent
Lockwood et al.

(10) Patent No.: US 8,590,645 B2
(45) Date of Patent: Nov. 26, 2013

(54) IMPREGNATED DRILL BITS AND METHODS OF MANUFACTURING THE SAME

(75) Inventors: Gregory T. Lockwood, Pearland, TX (US); Jonan Fulenchek, Tomball, TX (US)

(73) Assignee: Smith International, Inc., Houston, TX (US)

( * ) Notice: Subject to any disclaimer, the term of this patent is extended or adjusted under 35 U.S.C. 154(b) by 7 days.

(21) Appl. No.: 13/221,425

(22) Filed: Aug. 30, 2011

(65) Prior Publication Data

US 2011/0308864 A1 Dec. 22, 2011

Related U.S. Application Data

(63) Continuation of application No. 12/122,526, filed on May 16, 2008, now Pat. No. 8,020,640.

(51) Int. Cl.
*E21B 10/43* (2006.01)

(52) U.S. Cl.
USPC ..... 175/431; 175/434

(58) Field of Classification Search
USPC ..... 175/431, 434
See application file for complete search history.

(56) References Cited

U.S. PATENT DOCUMENTS 4,667,756 A * 5/1987 King et al. ..... 175/425
4,714,120 A * 12/1987 King ..... 175/431
5,007,493 A * 4/1991 Coolidge et al. ..... 175/432
5,147,001 A * 9/1992 Chow et al. ..... 175/428
5,282,513 A * 2/1994 Jones ..... 175/434
6,095,265 A * 8/2000 Alsup ..... 175/379
6,241,036 B1 * 6/2001 Lovato et al. ..... 175/432
6,408,958 B1 * 6/2002 Isbell et al. ..... 175/431
6,510,906 B1 * 1/2003 Richert et al. ..... 175/39
6,742,611 B1 * 6/2004 Illerhaus et al. ..... 175/433
6,843,333 B2 * 1/2005 Richert et al. ..... 175/379
7,497,280 B2 * 3/2009 Brackin et al. ..... 175/374
7,625,521 B2 * 12/2009 Izaguirre et al. ..... 419/10
7,730,976 B2 * 6/2010 McClain et al. ..... 175/431
7,878,275 B2 * 2/2011 Lockwood et al. ..... 175/425
7,954,571 B2 * 6/2011 McClain et al. ..... 175/431
7,963,348 B2 * 6/2011 Laird et al. ..... 175/263
8,020,640 B2 * 9/2011 Lockwood et al. ..... 175/431
8,100,203 B2 * 1/2012 Lockwood et al. ..... 175/434
2003/0111273 A1 * 6/2003 Richert et al. ..... 175/426
2004/0245022 A1 * 12/2004 Izaguirre et al. ..... 175/374
2004/0245024 A1 * 12/2004 Kembaiyan ..... 175/425
2006/0162967 A1 * 7/2006 Brackin et al. ..... 175/374
2007/0205023 A1 * 9/2007 Hoffmaster et al. ..... 175/408
2008/0017421 A1 * 1/2008 Lockwood ..... 175/434
2008/0282618 A1 * 11/2008 Lockwood ..... 51/295
2009/0107732 A1 * 4/2009 McClain et al. ..... 175/398
2009/0120008 A1 * 5/2009 Lockwood et al. ..... 51/295
2009/0120693 A1 * 5/2009 McClain et al. ..... 175/413
2009/0145668 A1 * 6/2009 Dourfaye et al. ..... 175/431
2009/0283334 A1 * 11/2009 Durairajan et al. ..... 175/413

(Continued)

*Primary Examiner* — Jennifer H Gay
(74) *Attorney, Agent, or Firm* — Osha Liang LLP

(57) ABSTRACT

A drill bit has a matrix bit body with a lower end face for engaging a rock formation, wherein the end face has a plurality of raised impregnated ribs extending from the face of the bit body and separated by a plurality of channels therebetween. At least one of the plurality of ribs has a leading or trailing portion thereof comprising the same the matrix material as the bit body forming a continuous body matrix.

5 Claims, 10 Drawing Sheets

(56) References Cited

U.S. PATENT DOCUMENTS

| | | | | |
|---|---|---|---|---|
| 2009/0283335 | A1* | 11/2009 | Lockwood et al. | 175/425 |
| 2009/0283336 | A1* | 11/2009 | Lockwood et al. | 175/434 |
| 2010/0101868 | A1* | 4/2010 | Izaguirre et al. | 175/428 |
| 2010/0126771 | A1* | 5/2010 | Entchev et al. | 175/57 |
| 2010/0206640 | A1* | 8/2010 | Lockwood et al. | 175/374 |
| 2010/0320005 | A1* | 12/2010 | Burhan et al. | 175/426 |
| 2011/0005837 | A1* | 1/2011 | Hoffmaster et al. | 175/57 |
| 2011/0114394 | A1* | 5/2011 | Lockwood et al. | 175/428 |
| 2011/0120781 | A1* | 5/2011 | Lockwood et al. | 175/425 |
| 2011/0174114 | A1* | 7/2011 | Lockwood et al. | 76/108.2 |
| 2011/0308864 | A1* | 12/2011 | Lockwood et al. | 175/425 |
| 2012/0024604 | A1* | 2/2012 | Hoffmaster et al. | 175/57 |

* cited by examiner

IMPREGNATED DRILL BITS AND METHODS OF MANUFACTURING THE SAME

CROSS-REFERENCE TO RELATED APPLICATIONS

This patent application is a continuation of U.S. Ser. No. 12/122,526, now U.S. Pat. No. 8,020,640, filed on May 16, 2008.

BACKGROUND OF INVENTION

1. Field of the Invention

Embodiments disclosed herein relate generally to drill bits, and more particularly to drill bits having impregnated cutting surfaces and the methods for the manufacture of such drill bits.

2. Background Art

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earth formation and proceeds to form a borehole along a predetermined path toward a target zone.

Different types of bits work more efficiently against different formation hardnesses. For example, bits containing inserts that are designed to shear the formation frequently drill formations that range from soft to medium hard. These inserts often have polycrystalline diamond compacts (PDC's) as their cutting faces.

Roller cone bits are efficient and effective for drilling through formation materials that are of medium to hard hardness. The mechanism for drilling with a roller cone bit is primarily a crushing and gouging action, in which the inserts of the rotating cones are impacted against the formation material. This action compresses the material beyond its compressive strength and allows the bit to cut through the formation.

For still harder materials, the mechanism for drilling changes from shearing to abrasion. For abrasive drilling, bits having fixed, abrasive elements are preferred. While bits having abrasive polycrystalline diamond cutting elements are known to be effective in some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

Diamond impregnated drill bits are commonly used for boring holes in very hard or abrasive rock formations. The cutting face of such bits contains natural or synthetic diamonds distributed within a supporting material to form an abrasive layer. During operation of the drill bit, diamonds within the abrasive layer are gradually exposed as the supporting material is worn away. The continuous exposure of new diamonds by wear of the supporting material on the cutting face is the fundamental functional principle for impregnated drill bits.

The construction of the abrasive layer is of critical importance to the performance of diamond impregnated drill bits. The abrasive layer typically contains diamonds and/or other super-hard materials distributed within a suitable supporting material. The supporting material must have specifically controlled physical and mechanical properties in order to expose diamonds at the proper rate.

Metal-matrix composites are commonly used for the supporting material because the specific properties can be controlled by modifying the processing or components. The metal-matrix usually combines a hard particulate phase with a ductile metallic phase. The hard phase often consists of tungsten carbide and other refractory or ceramic compounds. Copper or other nonferrous alloys are typically used for the metallic binder phase. Common powder metallurgical methods, such as hot-pressing, sintering, and infiltration are used to form the components of the supporting material into a metal-matrix composite. Specific changes in the quantities of the components and the subsequent processing allow control of the hardness, toughness, erosion and abrasion resistance, and other properties of the matrix.

Proper movement of fluid used to remove the rock cuttings and cool the exposed diamonds is important for the proper function and performance of diamond impregnated bits. The cutting face of a diamond impregnated bit typically includes an arrangement of recessed fluid paths intended to promote uniform flow from a central plenum to the periphery of the bit. The fluid paths usually divide the abrasive layer into distinct raised ribs with diamonds exposed on the tops of the ribs. The fluid provides cooling for the exposed diamonds and forms a slurry with the rock cuttings. The slurry must travel across the top of the rib before reentering the fluid paths, which contributes to wear of the supporting material.

An example of a prior art diamond impregnated drill bit is shown in FIG. 1. The impregnated bit 10 includes a bit body 12 and a plurality of ribs 14 that are formed in the bit body 12. The ribs 14 are separated by channels 16 that enable drilling fluid to flow between and both clean and cool the ribs 14. The ribs 14 are typically arranged in groups 20 where a gap 18 between groups 20 is typically formed by removing or omitting at least a portion of a rib 14. The gaps 18, which may be referred to as "fluid courses," are positioned to provide additional flow channels for drilling fluid and to provide a passage for formation cuttings to travel past the drill bit 10 toward the surface of a wellbore (not shown).

Impregnated bits are typically made from a solid body of matrix material formed by any one of a number of powder metallurgy processes known in the art. During the powder metallurgy process, abrasive particles and a matrix powder are infiltrated with a molten binder material. Upon cooling, the bit body includes the binder material, matrix material, and the abrasive particles suspended both near and on the surface of the drill bit. The abrasive particles typically include small particles of natural or synthetic diamond. Synthetic diamond used in diamond impregnated drill bits is typically in the form of single crystals. However, thermally stable polycrystalline diamond (TSP) particles may also be used.

In one impregnated bit forming process, the shank of the bit is supported in its proper position in the mold cavity along with any other necessary formers, e.g. those used to form holes to receive fluid nozzles. The remainder of the cavity is filled with a charge of tungsten carbide powder. Finally, a binder, and more specifically an infiltrant, typically a nickel brass copper based alloy, is placed on top of the charge of powder. The mold is then heated sufficiently to melt the infiltrant and held at an elevated temperature for a sufficient period to allow it to flow into and bind the powder matrix or matrix and segments. For example, the bit body may be held at an elevated temperature (>1800° F.) for a period on the order of 0.75 to 2.5 hours, depending on the size of the bit body, during the infiltration process.

By this process, a monolithic bit body that incorporates the desired components is formed. One method for forming such a bit structure is disclosed in U.S. Pat. No. 6,394,202 (the '202 patent), which is assigned to the assignee of the present invention and is hereby incorporated by reference.

Referring now to FIG. 2, a drill bit 22 in accordance with the '202 patent comprises a shank 24 and a crown 26. Shank 24 is typically formed of steel and includes a threaded pin 28 for attachment to a drill string. Crown 26 has a cutting face 29 and outer side surface 30. According to one embodiment, crown 26 is formed by infiltrating a mass of tungsten-carbide powder impregnated with synthetic or natural diamond, as described above.

Crown 26 may include various surface features, such as raised ridges 32. Preferably, formers are included during the manufacturing process so that the infiltrated, diamond-impregnated crown includes a plurality of holes or sockets 34 that are sized and shaped to receive a corresponding plurality of diamond-impregnated inserts 36. Once crown 26 is formed, inserts 36 are mounted in the sockets 34 and affixed by any suitable method, such as brazing, adhesive, mechanical means such as interference fit, or the like. As shown in FIG. 2, the sockets can each be substantially perpendicular to the surface of the crown. Alternatively, and as shown in FIG. 2, holes 34 can be inclined with respect to the surface of the crown 26. In this embodiment, the sockets are inclined such that inserts 36 are oriented substantially in the direction of rotation of the bit, so as to enhance cutting.

With respect to the diamond material to be incorporated (either as an insert, or on the bit, or both), diamond granules are formed by mixing diamonds with matrix power and binder into a paste. The paste is then extruded into short "sausages" that are rolled and dried into irregular granules. The process for making diamond-impregnated matrix for bit bodies involves hand mixing of matrix powder with diamonds and a binder to make a paste. The paste is then packed into the desired areas of a mold. The resultant irregular diamond distribution has clusters with too many diamonds, while other areas are void of diamonds. The diamond clusters lack sufficient matrix material around them for good diamond retention. The areas void or low in diamond concentration have poor wear properties. Accordingly, the bit or insert may fail prematurely, due to uneven wear. As the motors or turbines powering the bit improve (higher sustained RPM), and as the drilling conditions become more demanding, the durability of diamond-impregnated bits needs to improve. However, generally, as durability of a bit increases (with a harder matrix), diamond exposure (and thus ROP) generally decreases, and vice versa.

Accordingly, there exists a continuing need for improvements in diamond impregnated bit to improve cuffing efficiency, so that rate of penetration may be increased without sacrificing durability.

SUMMARY OF INVENTION

In one aspect, embodiments disclosed herein relate to a drill bit that includes a body having a lower end face for engaging a rock formation, the end face having a plurality of raised ribs extending from the face of the bit body and separated by a plurality of channels therebetween; at least one of the plurality of ribs having a leading portion and a trailing portion, the leading portion comprising a first matrix material impregnated with super abrasive particles and the trailing portion comprising a second matrix material impregnated with super abrasive particles, wherein the first and second matrix materials differ from each other.

In another aspect, embodiments disclosed herein relate to a drill bit that includes a matrix bit body having a lower end face for engaging a rock formation, the end face having a plurality of raised impregnated ribs extending from the face of the bit body and separated by a plurality of channels therebetween; at least one of the plurality of ribs having a leading or trailing portion thereof comprising the same the matrix material as the bit body forming a continuous body matrix.

In another aspect, embodiments disclosed herein relate to a drill bit that includes a body having a lower end face for engaging a rock formation, the end face having a plurality of raised ribs extending from the face of the bit body and separated by a plurality of channels therebetween; at least one of the plurality of ribs having a leading or trailing portion thereof comprising preformed diamond impregnated volumetric bodies stacked therein.

In another aspect, embodiments disclosed herein relate to a drill bit that includes a body having a lower end face for engaging a rock formation, the end face having a plurality of raised impregnated ribs extending from the face of the bit body and separated by a plurality of channels therebetween; and at least one of the plurality of ribs having a leading portion and a trailing portion having differing wear properties, wherein the leading and trailing portion of the at least one rib vary radially along the rib.

In yet another aspect, embodiments disclosed herein relate to a method of manufacturing a drill bit including a bit body and a plurality of ribs extending from the bit body, the method including loading a plurality of first abrasive particles and a first matrix material into a portion of a mold cavity corresponding to a leading portion of the rib; loading a second matrix material into the other portion of the mold cavity corresponding to the other portion of the rib; and heating the mold contents to form an impregnated drill bit.

Other aspects and advantages of the invention will be apparent from the following description and the appended claims.

DETAILED DESCRIPTION

Embodiments disclosed herein relate to impregnated drill bits and methods of manufacturing and using the same. As used herein, use of the term "impregnated" refers to a cutting structure that possesses a plurality of superabrasive particles dispersed within at least a portion of the cutting structure. Thus, in an impregnated rib or bit, at least a portion of the rib or bit is impregnated within super abrasive particles.

More specifically, embodiments disclosed herein relate to impregnated drill bits designed so that its rib(s) may become tapered in situ during use downhole. While a bit may be formed with a tapered surface (e.g., backraked rib) during manufacturing, once used in a drilling operation, the taper may quickly wear away. Thus, embodiments of the present disclosure may allow for the formation and maintenance of a taper. That is, during drilling, as the bit wears, it continuously wears in a designed manner to have a tapered surface.

Figure 1:
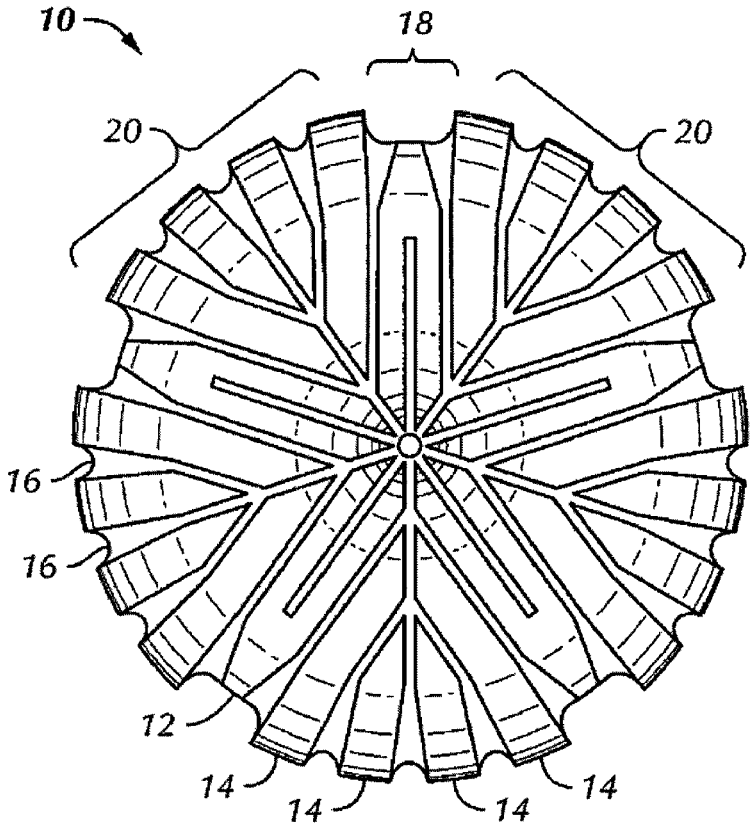
FIG. 1 (Prior Art)
FIG. 1 is a prior art impregnated bit.
Figure 2:
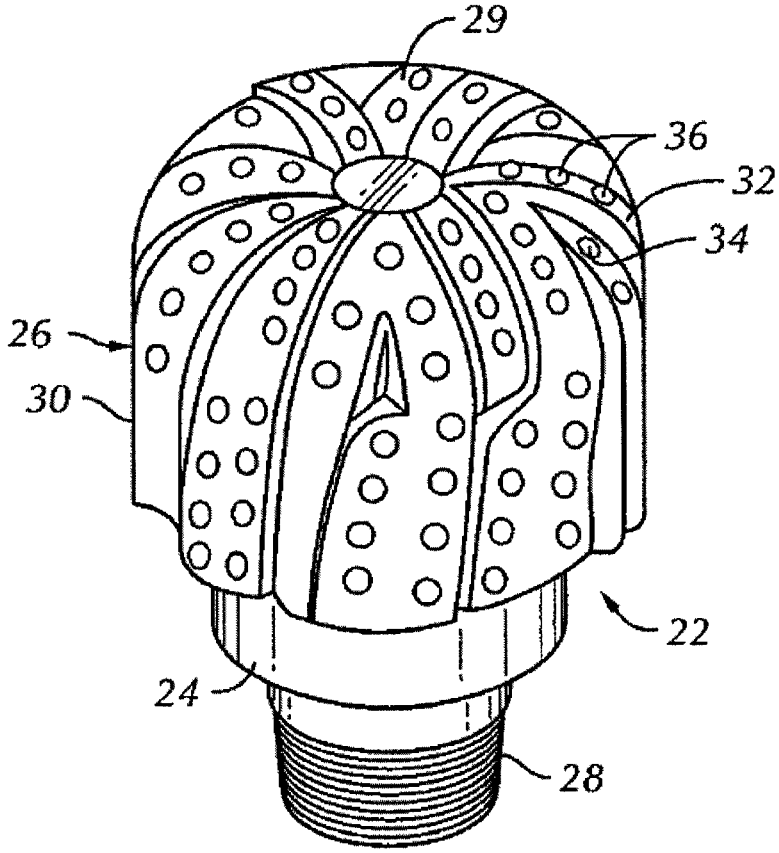
FIG. 2 (Prior Art)
FIG. 2 is a prior art impregnated bit.
Figure 3:
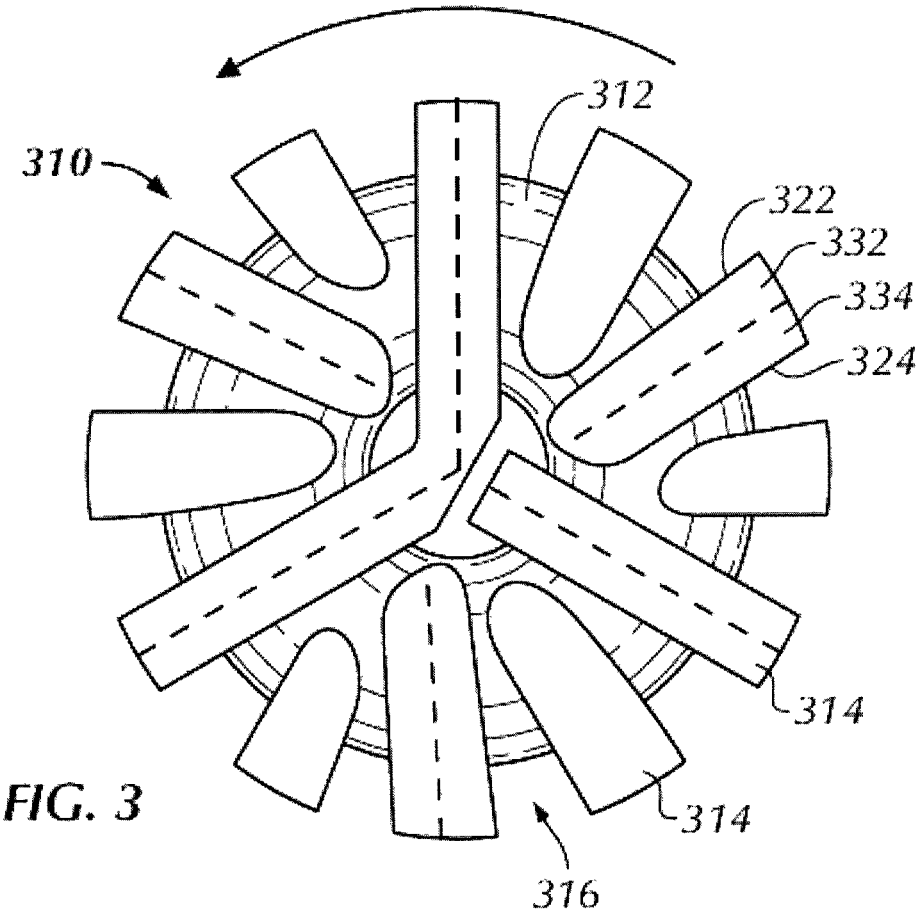
FIG. 3 shows a top view of a bit in accordance with one embodiment of the present disclosure.

Referring to FIG. 3, one embodiment of a drill bit of the present disclosure is shown. As shown in FIG. 3, a bit 310 includes a bit body 312 and a plurality of impregnated ribs 314 that are formed in the bit body 312. The ribs 314 are separated by channels 316 that enable drilling fluid to flow between and both clean and cool the ribs 314. A rib 314 may possess two edges, a leading edge 322 and a trailing edge 324, which are determined by the direction in which the bit rotates downhole. The leading edge 322 is the edge of the rib 314 which faces the direction of rotation of the bit 310, as indicated by the arrow shown in FIG. 3, whereas the trailing edge 324 is the edge of the rib that does not face the direction of rotation of the bit 310. As shown in FIGS. 3-4, at least one of the ribs may be divided into two sections, a leading portion 332 and a trailing portion 334, which comprise the leading edge 322 and trailing edge 324, respectively. As shown in FIG. 3, the leading/trailing portions 332, 334 are included on alternating ribs; however, the present disclosure is not so limiting. Rather, it is within the scope of the present disclosure that the leading/trailing portions 332, 334 may be included on any number of ribs 314.

In accordance with embodiments of the present disclosure, the leading portion 332 and trailing portion 334 may be formed from different materials. For example, leading portion may be formed from a matrix material impregnated with super abrasive particles while the trailing portion may be formed of a different impregnated material (either in matrix material or in the impregnated particles) or a matrix material devoid of impregnated particles. Further, in a particular embodiment, the leading portion 332 and trailing portion 334 may be formed of materials to result in a hardness difference of at least 7 HRC and up to 50 HRC between the two portions of the rib.

According to one embodiment of the present disclosure, the impregnated matrix material of the leading portion is chosen to be different from the impregnated matrix material (or matrix material devoid of impregnated particles) of the trailing portion. This difference between the materials between the leading and trailing portions may include variations in chemical make-up or particle size ranges/distribution, which may translate, for example, into a difference in wear or erosion resistance properties of the rib portions. Thus, for example, different types of carbide (or other hard) particles may be used among the different types of matrix materials. One of ordinary skill in the art would appreciate that a particular variety of tungsten carbide, for example, may be selected based on hardness/wear resistance. Further, chemical make-up of a matrix powder material may also be varied by altering the percentages/ratios of the amount of hard particles as compared to binder powder. Thus, by decreasing the amount of tungsten carbide particle and increasing the amount of binder powder in a portion of the rib, a softer portion of the rib may be obtained, and vice versa. In a particular embodiment, the matrix materials may be selected so that the matrix material of the trailing portion comprises a tougher, softer material.

Additionally, in various embodiments, the leading portion and/or the trailing portion may be formed of encapsulated particles to provide for impregnation described above. The use of encapsulated particles in cutting structures is described for example in U.S. Patent Publication No. 2006/0081402 and U.S. application Ser. Nos. 11/779,083, 11/779,104, and 11/937,969, all of which are assigned to the present assignee, and herein incorporated by reference in their entireties. Briefly, encapsulated particles are formed of super abrasive particles coated or surrounded by encapsulating shell of matrix powder material. The encapsulated particles may be infiltrated with an infiltrating material that may include an infiltration binder and an optional matrix powder material.

Super Abrasive Particles

The super abrasive particles may be selected from synthetic diamond, natural diamond, reclaimed natural or synthetic diamond grit, cubic boron nitride (CBN), thermally stable polycrystalline diamond (TSP), silicon carbide, aluminum oxide, tool steel, boron carbide, or combinations thereof. In various embodiments, the leading portion and trailing portion may be impregnated with particles selected to result in a more abrasive leading portion as compared to trailing portion (or vice versa). Thus, the impregnated particles may be selected to differ in type (i.e., chemical composition), quality (strength), size, concentration, and/or retention coatings, all of which may alter the resulting materials properties of the rib portions.

The shape of the abrasive particles may also be varied as abrasive particles may be in the shape of spheres, cubes, irregular shapes, or other shapes. In some embodiments, abrasive particles may range in size from 0.2 to 2.0 mm in length or diameter; from 0.3 to 1.5 mm in other embodiments; from 0.4 to 1.2 mm in other embodiments; and from 0.5 to 1.0 mm in yet other embodiments.

However, particle sizes are often measured in a range of mesh sizes, for example −40+80 mesh. The term "mesh" actually refers to the size of the wire mesh used to screen the particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are standard U.S. mesh sizes. For example, a standard 40 mesh screen has holes such that only particles having a dimension less than 420 μm can pass. Particles having a size larger than 420 μm are retained on a 40 mesh screen and particles smaller than 420 μm pass through the screen. Therefore, the range of sizes of the particles is defined by the largest and smallest grade of mesh used to screen the particles. Particles in the range of −16+40 mesh (i.e., particles are smaller than the 16 mesh screen but larger than the 40 mesh screen) will only contain particles larger than 420 μm and smaller than 1190 μm, whereas particles in the range of −40+80 mesh will only contain particles larger than 180 μm and smaller than 420 μm.

Thus, in some embodiments, abrasive particles may include particles not larger than would be filtered by a screen of 10 mesh. In other embodiments, abrasive particles may range in size from −15+35 mesh. In a particular embodiment, the leading portion may include abrasive particles ranging in size from −25+35 mesh, while the trailing portion may include abrasive particles ranging in size from −20+25 mesh. However, one of ordinary skill would recognize that the particle sizes and distribution of the particle sizes of the abrasive particles may be selected to allow for a broad, uniform, or bimodal distribution, for example, depending on a particular application, and that size ranges outside the distribution discussed above may also be selected. Further, although particle sizes or particle diameters are referred to, it is understood by those skilled in the art that the particles may not necessarily be spherical in shape.

Further, as discussed above, various abrasive particles that may be selected for use in the ribs may vary in type (i.e., chemical composition) such that the various portions of a rib may use different types of abrasive particles; however, one of ordinary skill in the art would appreciate that among these particles, there may also be a difference in compressive strength of the particles. For example, some synthetic diamond grit may have a greater compressive strength than natural diamond grit and/or reclaimed grit. Furthermore, even within the general synthetic grit type, there may exist different grades of grit having differing compressive strengths, such as those grades of grit commercially available from Element Six Ltd. (Berkshire, England). For example, recycled diamond grit (reduced strength due to multiple high temperature exposures) could be used as the abrasive particles within the trailing portion so as to render the trailing portion less wear resistant that the leading edge.

In addition to varying the strength of the abrasive particles, the presence and identity of retention coating on the surface of the abrasive particle may also optionally be varied. Such retention coatings may be applied by conventional techniques such as CVD or PVD. One of ordinary skill in the art would appreciate that the thin coatings (having a thickness of only a few micrometers) may be more helpful for high temperature protection (e.g., SiC coatings) while others are helpful for grit retention (e.g., TiC). In certain embodiments, the retention coating (TiC in the above example) may help bond the diamond to the "outer" matrix material in which the abrasive particles are impregnated. Additionally, in certain applications the retention coating may reduce thermal damage to the particles. For example, different coatings may be used between abrasive particles on the various rib portions, such as for example, a weaker PVD coating could be applied on the particles in the trailing portion of the rib, and a stronger CVD coating on abrasive particles in the leading portion of the rib, leading to a less wear resistant trailing portion.

Matrix Material

The impregnated particles may be dispersed in a continuous matrix material formed from a matrix powder and infiltrating binder material. The matrix powder material may include a mixture of a carbide compounds and/or a metal alloy using any technique known to those skilled in the art. For example, matrix powder material may include at least one of macrocrystalline tungsten carbide particles, carburized tungsten carbide particles, cast tungsten carbide particles, and sintered tungsten carbide particles. In other embodiments non-tungsten carbides of vanadium, chromium, titanium, tantalum, niobium, and other carbides of the transition metal group may be used. In yet other embodiments, carbides, oxides, and nitrides of Group IVA, VA, or VIA metals may be used. Typically, a binder phase may be formed from a powder component and/or an infiltrating component. In some embodiments of the present invention, hard particles may be used in combination with a powder binder such as cobalt, nickel, iron, chromium, copper, molybdenum and their alloys, and combinations thereof. In various other embodiments, an infiltrating binder may include a Cu—Mn—Ni alloy, Ni—Cr—Si—B—Al—C alloy, Ni—Al alloy, and/or Cu—P alloy. In other embodiments, the infiltrating matrix material may include carbides in amounts ranging from 0 to 70% by weight in addition to at least one binder in amount ranging from 30 to 100% by weight thereof to facilitate bonding of matrix material and impregnated materials. In a particular embodiment, the leading portion's matrix material may be formed from 50-70% by weight carbide (balance metal), while the trailing portion's matrix material may be formed from 0-50% by weight carbide (balance metal). Further, one skilled in the art would appreciate that temporary binders such as solvents, organix waxes, adhesive materials, platicizers, etc. may be used to aid in manufacturing.

Further, with respect to particle sizes, each type of matrix material (for respective portions of a rib) may be individually be selected from particle sizes that may range in various embodiments, for example, from about 1 to 200 micrometers, from about 1 to 150 micrometers, from about 10 to 100 micrometers, and from about 5 to 75 micrometers in various other embodiments or may be less than 50, 10, or 3 microns in yet other embodiments. In a particular embodiment, each type of matrix material (for respective types of rib portions) may have a particle size distribution individually selected from a mono, bi- or otherwise multi-modal distribution.

In a particular embodiment, the leading portion may have a broad particle size range and multi-modal distribution in order to increase the volume fraction of carbides and limiting the metal content. Further, the leading portion may also optionally use a higher percentage of large carbide particles, which may result in better retention in fluid erosion applications due to having more surface area anchored to the binder matrix. Conversely, the trailing portion, which may be designed to wear quicker, may have a more narrow size distribution to reduce the packing factor of carbide and increase the infiltration metal content. In addition, the trailing portion may use finer particles, as compared to the leading portion, to have less anchoring with binder matrix to promote faster pull-out.

Types of Tungsten Carbide

Tungsten carbide is a chemical compound containing both the transition metal tungsten and carbon. This material is known in the art to have extremely high hardness, high compressive strength and high wear resistance which makes it ideal for use in high stress applications. Its extreme hardness makes it useful in the manufacture of cutting tools, abrasives and bearings, as a cheaper and more heat-resistant alternative to diamond.

Sintered tungsten carbide, also known as cemented tungsten carbide, refers to a material formed by mixing particles of tungsten carbide, typically monotungsten carbide, and particles of cobalt or other iron group metal, and sintering the mixture. In a typical process for making sintered tungsten carbide, small tungsten carbide particles, e.g., 1-15 micrometers, and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or pellets such as by pressing through a screen, or tumbling and then screened to obtain more or less uniform pellet size.

Such green compacts or pellets are then heated in a vacuum furnace to first evaporate the wax and then to a temperature near the melting point of cobalt (or the like) to cause the tungsten carbide particles to be bonded together by the metallic phase. After sintering, the compacts are crushed and screened for the desired particle size. Similarly, the sintered pellets, which tend to bond together during sintering, are crushed to break them apart. These are also, screened to obtain a desired particle size. The crushed sintered carbide is generally more angular than the pellets, which tend to be rounded.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. In one embodiment of the present invention, the cast tungsten carbide used in the mixture of tungsten carbides is comprised of from about 3.7 to about 4.2 weight percent carbon.

Another type of tungsten carbide is macro-crystalline tungsten carbide. This material is essentially stoichiometric WC. Most of the macro-crystalline tungsten carbide is in the form of single crystals, but some bicrystals of WC may also form in larger particles. Single crystal monotungsten carbide is commercially available from Kennametal, Inc., Fallon, Nev.

Carburized carbide is yet another type of tungsten carbide. Carburized tungsten carbide is a product of the solid-state diffusion of carbon into tungsten metal at high temperatures in a protective atmosphere. Sometimes it is referred to as fully carburized tungsten carbide. Such carburized tungsten carbide grains usually are multi-crystalline, i.e., they are composed of WC agglomerates. The agglomerates form grains that are larger than the individual WC crystals. These large grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of WC, with total carbon content in the range of about 6.08% to about 6.18% by weight.

Of the types of carbides described above, one skilled in the art would appreciate that any combination of particular carbides may be selected, depending on the desired resulting properties and application of the bit. For example, as cast tungsten carbide is known to improve erosion resistance in impregnated or PDC bits, it may be desirable to form the leading portion as containing a higher percentage of cast tungsten carbide to promote good erosion resistance, while the trailing portion may be formed having at least 10% by weight less cast carbide compared to leading portion.

Further, when using cast tungsten carbide, one skilled in the art would appreciate that, in addition to improve erosion resistance, cast carbide also makes the matrix brittle, thus conventionally limiting its use to less than 50% by weight (balance of other tungsten carbide types plus metal binder) for impregnated bits because adding super abrasive particles further reduces the toughness of tungsten carbide matrix, resulting in increased blade breakage. However, in accordance with the present disclosure, a leading portion may be formed with a very high cast carbide percentage, 50-80% cast carbide (balance infiltration metal binder), with diamond grit in the leading edge area for maximum erosion resistance, while the trailing portion may be formed using a very low cast carbide percentage (with less wear resistant carbides compared to cast carbide). In such an embodiment, while the leading portion is formed with amounts of cast carbide that conventionally would be through to be deleterious, the trailing portion will be tougher to reduce the chances of blade breakage.

Figure 4A:
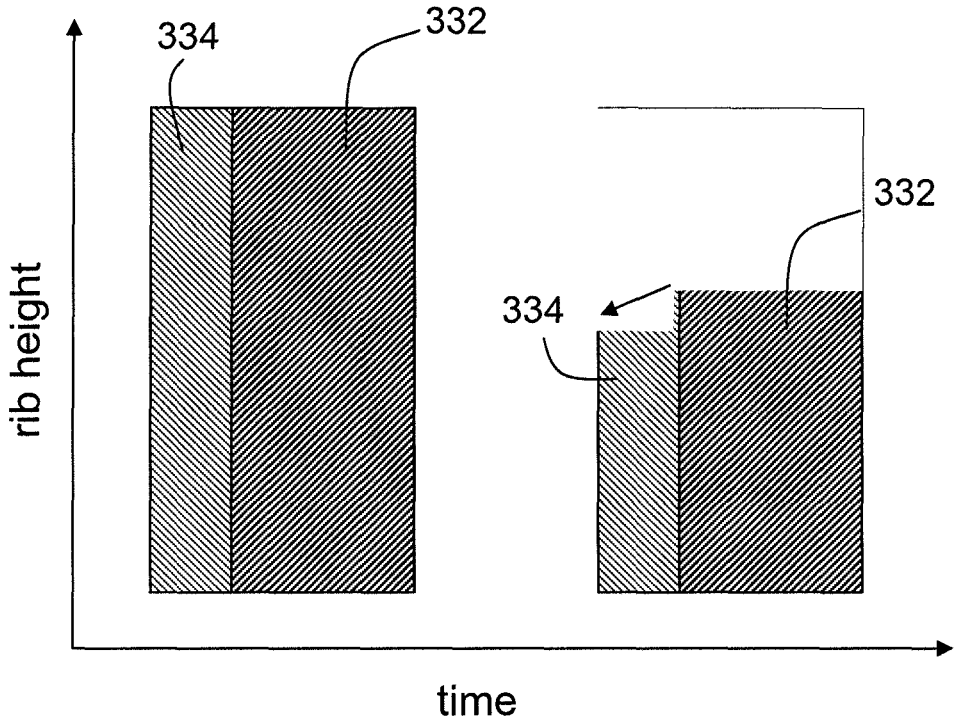
FIGS. 4A-C show various ribs in accordance with embodiments of the present disclosure.

Now referring to FIG. 4A, one of ordinary skill in the art would recognize that the wear properties of a leading portion 332 relative to trailing portion 334 may be tailored by changing their respective chemical makeup. Depending on the anticipated final use of the cutting structure, trailing portion 334 may be softer and less wear resistant than leading portion 332, so that as a bit drills through a formation, a taper is formed by the increased wear of the trailing portion 334 as compared to the leading portion 332. However, one skilled in the art would appreciate that the alternative wear pattern (softer leading portion) is also within the scope of the present disclosure. In such an embodiment, the relative ease of erosion of trailing portion 334 would allow improved erosion of matrix surrounding the abrasive grit, resulting in increased depth of cut (ROP), and also providing the cuttings increased room to escape which also helps ROP. Thus, variable wear between different portions of a rib may allow for dual optimization of rate of penetration (ROP) and durability, which are otherwise inapposite performance characteristics. That is, for increased ROP, increased rates of diamond exposure are necessary (and thus less wear resistance of the matrix material in which the diamonds are impregnated); however, for durability, greater wear resistance of the matrix material is desirable so that the bit does not wear away as quickly.

Figure 4B:
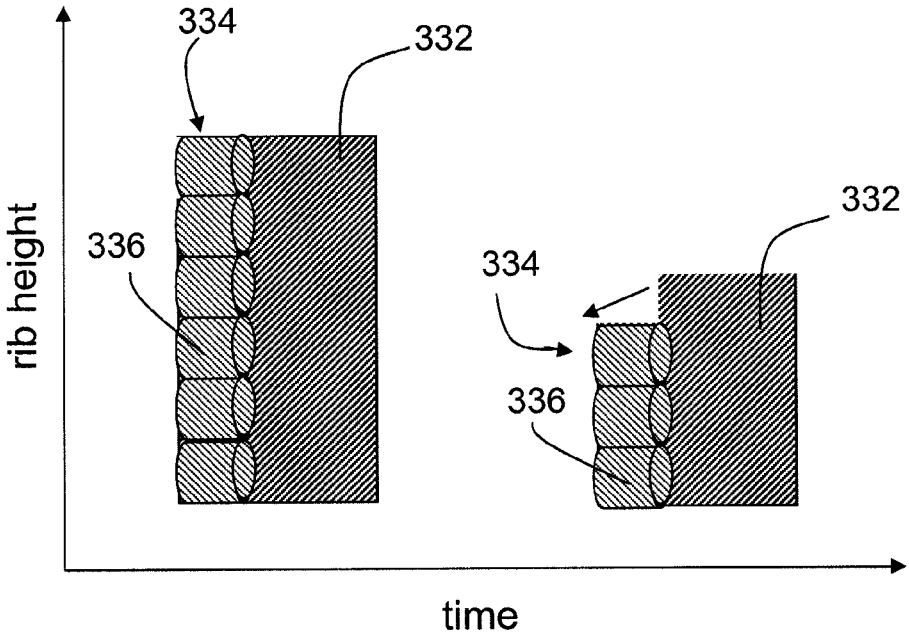
Figure 4C:
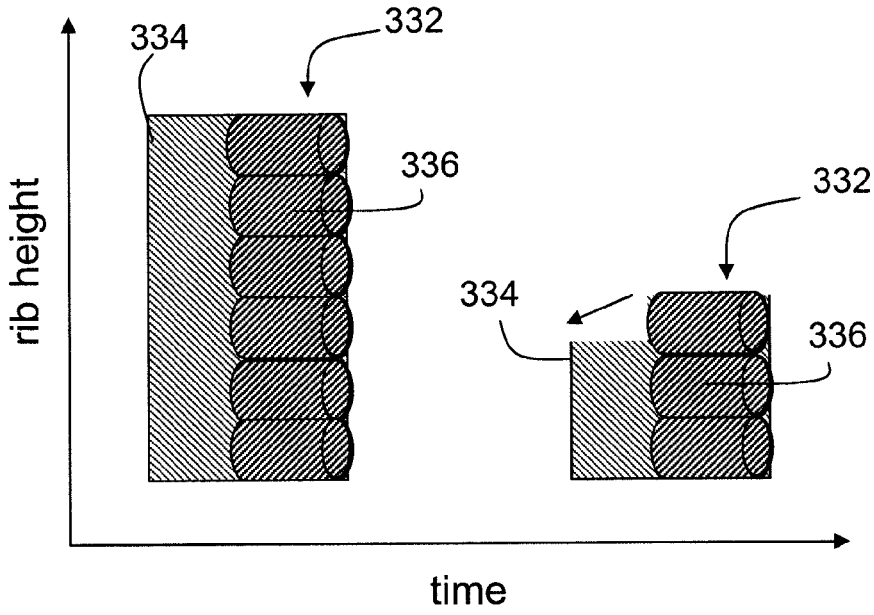

Further, referring to FIGS. 4B and 4C, either the leading portion 332 or trailing portion 334 may be formed of preformed inserts 336 stacked within the rib, along its length, in a side by side fashion. Such preformed inserts may include a consolidated or hot pressed insert, such as the type described in U.S. Pat. No. 6,394,202, which is assigned to the present assignee and herein incorporated by reference in its entirety. Similar to other embodiments of impregnated ribs, such preformed inserts may include super abrasive particles dispersed within a continuous matrix material. Further, such preformed inserts may be formed from encapsulated particles, as described in U.S. Patent Publication No. 2006/0081402 and U.S. application Ser. Nos. 11/779,083, 11/779,104, and 11/937,969. Further, while FIGS. 4B and 4C show generally cylindrical preformed inserts, the present invention is not so limited. Rather, one skilled in the art would appreciate that preformed inserts of any geometry, whether symmetrical (including cylinders or cubes) or asymmetrical, may be used.

As shown in FIG. 4B, trailing portion 334 may be formed from preformed inserts 336 that are softer and less wear resistant than the impregnated material forming the leading portion 332, so that as a bit drills through a formation, a taper is formed by the increased wear of the trailing portion 334 as compared to the leading portion 332. Conversely, as shown in FIG. 4C, leading portion 332 may be formed from preformed inserts 336 that are harder and more wear resistant than the impregnated materials forming trailing portion 334, so that as a bit drills through a formation, a taper is formed by the increased wear of the trailing portion 334 as compared to the leading portion 332.

Figure 5:
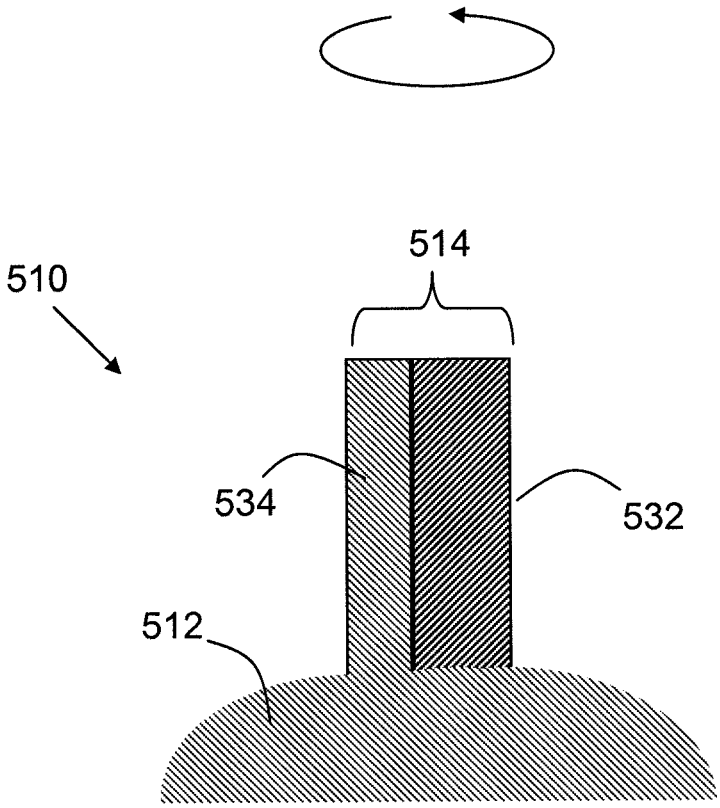
FIG. 5 shows a cross-section view of a bit in accordance with one embodiment of the present disclosure.

Referring to FIG. 5, another embodiment of the present disclosure is shown. As shown in FIG. 5, a bit 510 may include a bit body 512 having a plurality of ribs 514 extending from the lower face thereof. At least one of the ribs 514 may be divided into two sections, a leading portion 532 and a trailing portion 534, which may be formed from different materials, as described above. According to various embodiments, one of the leading portion 532 and trailing portion 534 comprise the same the matrix material as the bit body 512 forming a continuous body matrix. As shown in FIG. 5, the trailing portion 534 forms a continuous body matrix with bit body 512. Further, one skilled in the art would appreciate that in such embodiments where one of the leading portion or trailing portion forms a continuous body matrix with the bit body, any of the materials described above with reference to FIGS. 3-4C may be used on either the leading portion 532 or trailing portion 534.

Figure 6:
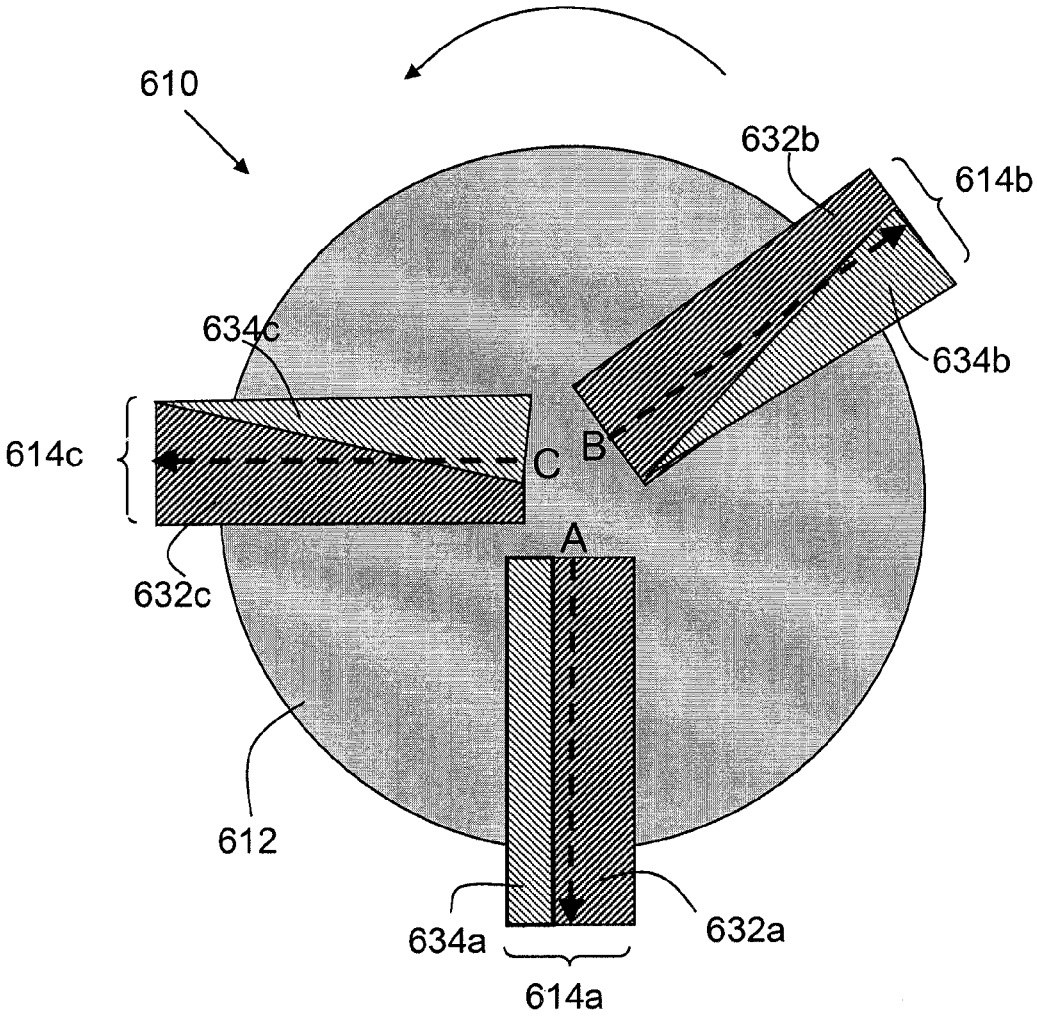
FIG. 6 shows a top view of a bit in accordance with one embodiment of the present disclosure.

Turning to FIG. 6, yet another embodiment of the present disclosure is shown. As shown in FIG. 6, a bit 610 includes a bit body 612 having a plurality of ribs 614 extending from the lower face thereof. At least one of the ribs 614 may be divided into two sections, a leading portion 632 and a trailing portion 634, which may be formed from different materials, as described. Further, according to one embodiment, at least one of the plurality of ribs 614 has a leading portion 632 and a trailing portion 634 that vary radially along the rib. For example, while rib 614*a* is not shown as varying radially along its length A, ribs 614*b* and 614*c* are both shown as having such variation. As shown, rib 614*b* includes a leading portion 632*b* that decreases while trailing portion 634*b* increases along length B. Conversely, rib 614*c* includes a leading portion 632*c* that increases while trailing portion decreases along length C. Further, one skilled in the art would appreciate that in such embodiments where the leading portion and trailing portion vary radially along the rib length, any of the materials described above with reference to FIGS. 3-5 may be used on either the leading portion 632 or trailing portion 634. In a particular embodiment, the trailing portion 634 may form a continuous body matrix with bit body 612. Further, one skilled in the art would appreciate that leading and trailing portions 632 and 634 need not be of equal volumes. For example, as illustrated in FIG. 6, leading portion 632*a* comprises a larger volume fraction of rib 614*a* than trailing portion 634*a*; however, one skilled in the art would appreciate that the converse may also be true.

Figure 7:
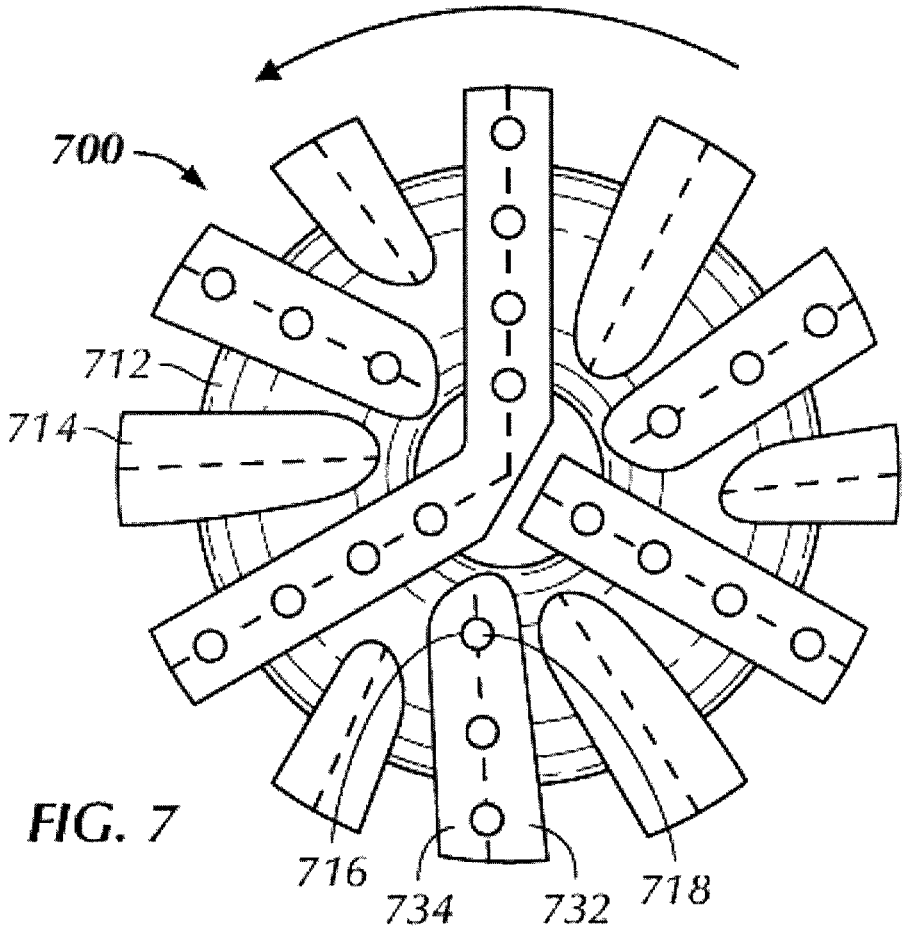
FIG. 7 shows a top view of a bit in accordance with one embodiment of the present disclosure.

Now turning to FIG. 7, yet another embodiment of the present disclosure is shown. As shown in FIG. 7, a bit 700 includes a bit body 712 having a plurality of ribs 714 extending from the lower face thereof. At least one of the ribs 714 may be divided into two sections, a leading portion 732 and a trailing portion 734, which may be formed from different materials, as described above. Further, according to one embodiment, at least one rib 714 may optionally be formed with spacers in the mold during the manufacturing process so that the rib includes a plurality of holes or sockets 716 that are sized and shaped to receive a corresponding plurality of preformed impregnated inserts 718. Once bit body 712 and ribs 714 are formed, inserts 718 may be mounted in the sockets 716 and affixed by any suitable method, such as brazing, adhesive, mechanical means such as interference fit, or the like. As shown in FIG. 7, the sockets 716 may each be substantially perpendicular to the surface of the rib 714 so that once inserted into sockets 716, inserts are substantially perpendicular to the surface of rib 714 (and may be flush with or extend beyond surface of rib). Alternatively, holes 716 can be inclined with respect to the surface of the rib. In this embodiment, the sockets 716 are inclined such that inserts 718 are oriented substantially in the direction of rotation of the bit, so as to enhance cutting. The preformed inserts used in this embodiment may include those described with reference to FIG. 4B-C, and thus, the particular orientation of the diamond impregnated inserts of the present disclosure within a bit does not have any limitation on the scope of the present disclosure.

Further, one skilled in the art would appreciate that in such embodiments where a plurality of preformed inserts are used in forming the bit, any of the materials described above with reference to FIGS. 3-5 may be used on either the leading portion 732 or trailing portion 734. In a particular embodiment, at least one of the leading or trailing portions may include preformed insert stacked in a side-by-side fashion, as shown in FIGS. 4B and 4C, in addition to having preformed inserts placed in sockets on a surface of the rib. In such an embodiment, one skilled in the art would appreciate that in view of space considerations, it may be necessary to alternate, along the length of the rib, the stacked preformed inserts with those preformed inserts inserted into sockets on the surface of the rib.

Figure 8:
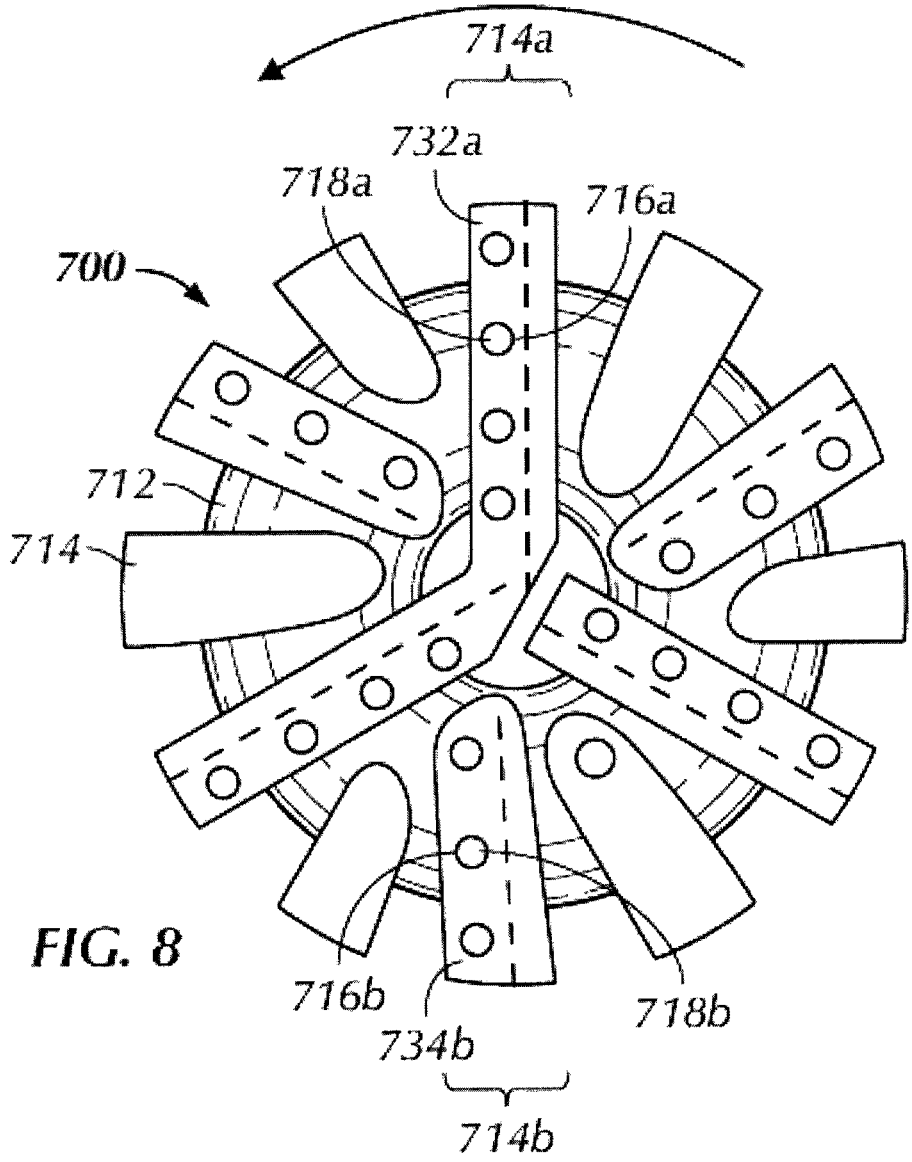
FIG. 8 shows a top view of a bit in accordance with one embodiment of the present disclosure.

Further, as shown in FIG. 7, each socket 716 may be formed as overlapping into trailing portion 732 and leading portion 734; however, one skilled in the art would appreciate in alternate embodiments a socket 716 may entirely be formed in either leading portion or trailing portion. For example, as shown in FIG. 8, sockets 716*a* may be formed entirely in leading portion 732*a* of rib 714*a*, and sockets 716*b* may be formed entirely in trailing portion 734*b* of rib 714*b*. As shown in FIGS. 7-8, preformed inserts 718, 718*a*, 718*b* are included on alternating ribs; however, the present disclosure is not so limiting. Rather, it is within the scope of the present disclosure that inserts 718 may be included on any number of ribs 714, including on ribs not possessing a differing leading and trailing portion. Use of preformed inserts 718 may allow for a variation in the rib profile (for example among alternating ribs) that may allow for dual optimization of ROP and durability.

Figure 9:
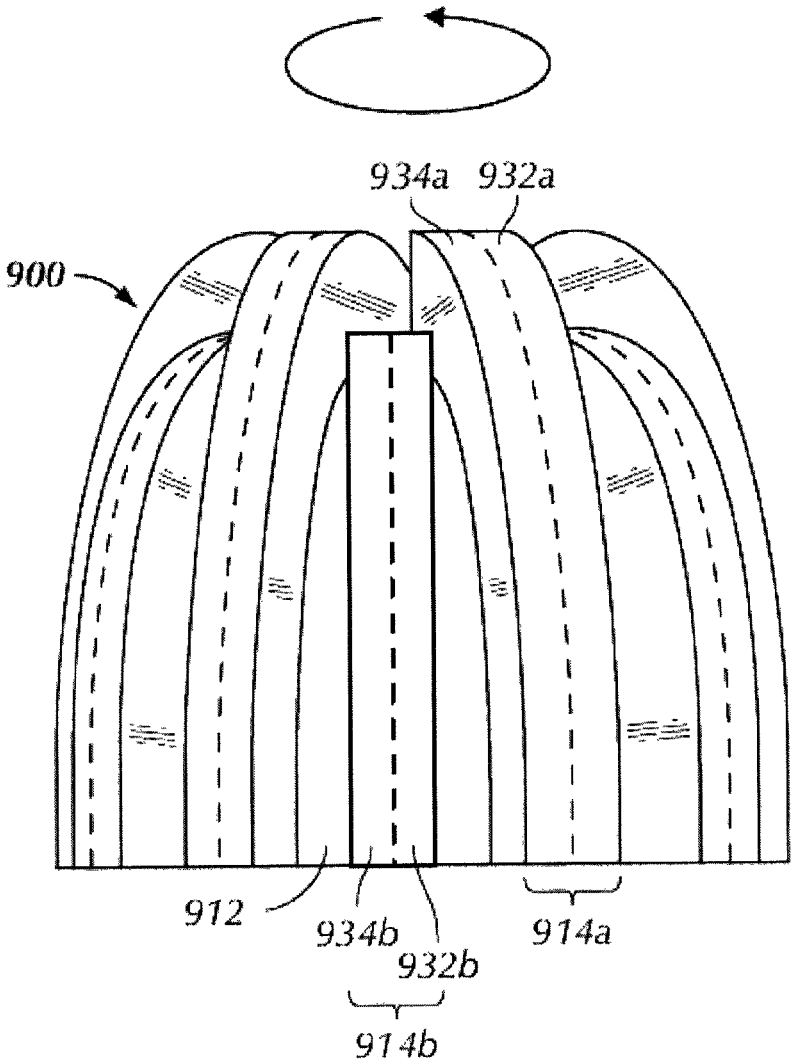
FIG. 9 shows a side view of a bit in accordance with one embodiment of the present disclosure.

Referring to FIG. 9, yet another embodiment of the present disclosure is shown. As shown in FIG. 9, a bit 900 includes a bit body 912 having a plurality of ribs 914*a*, 914*b* extending from the lower face thereof. At least one of the ribs 914*a*, 914*b* may be divided into two sections, a leading portion 932*a*, 932*b* and a trailing portion 934*a*, 934*b*, which may be formed from different materials, as described above. Further, according to one embodiment, ribs 914*a*, 914*b* may vary in their profile and/or profile height, such as in an alternating fashion. For example, as shown, rib 914*a* has a taller profile, as compared to rib 914*b*. While ribs 914*a* and 914*b* are illustrated of each being comprised of leading portions 932*a*, 932*b* and trailing portions 934*a*, 934*b*, the present invention is not so limited. Rather, one skilled in the art would appreciate that in a particular embodiment only one of rib 914*a* and 914*b* may be comprised of differing leading and trailing portions. In a particular embodiment, the rib having a taller profile may be formed of a leading portion and a trailing portion of differing materials, while the rib having the shorter profile may be formed of a single material. Further, one skilled in the art would appreciate that in such embodiments where ribs of differing profiles and/or profile heights are used in forming the bit, any of the materials described above with reference to FIGS. 3-5 may be used in forming the ribs, including either the leading portion 732 or trailing portion 734 of a rib in which such features are so provided. In a particular embodiment, inserts 718, as described in FIGS. 7-8 may also be provided on the various rib profiles, including either taller or shorter ribs.

Manufacturing techniques may be used to form an infiltrated bit body of the present disclosure may begin with the fabrication of a mold, having the desired body shape and component configuration. A mixture of matrix material and diamond (for example, in a clay-like mixture or as preformed inserts) may be loaded into the mold in the desired location, i.e., into either the leading or trailing portion of a rib. The other of the leading or trailing portion of the rib may be filled with a differing material, and the ribs may be infiltrated with a molten infiltration binder and cooled to form a bit body.

Optionally, a matrix material, and optionally a metal binder powder, may be loaded on top of the materials forming the rib portions. In a particular embodiment, during infiltration a loaded matrix material may be carried down with the molten infiltrant to fill any gaps between the particles. Further, one skilled on the art would appreciate that other techniques such as casting may alternatively be used.

Several of the various techniques that may be used are now described, with reference to the above described bit structures described herein. For example, referring back to FIG. 4A, a thin plastic divider (or divider of any suitable material such a copper, aluminum, or other metal sheet) may be placed in the mold dividing a rib into a leading portion 332 and trailing portion 334. Either the portion of the mold corresponding to the leading 332 or trailing portion 334 may then be filled with the component materials described above. In a particular embodiment, the materials (diamond and matrix powder) may be combined as premixed pastes, which may then be packed into the mold in the respective leading and trailing portions of the mold. Depending on the type of materials used as the divider, the divider may be removed, or may be left in place if, for example, a copper sheet is used, and the bit may then be infiltrated with an infiltrating binder.

Referring to FIG. 5, a premixed paste may be placed in the portion of a mold corresponding to either of the leading or trailing portions of the rib, and the mold cavity corresponding to the remaining portion of the rib and bit body may be filled with a dry carbide powder (and optionally vibrated) prior to infiltration.

By using a paste-like mixture of superabrasives, carbides, and metal powders, the mixture may possess structural cohesiveness beneficial in forming a rib having the material make-up disclosed herein. Such types of materials are described in U.S. patent application Ser. No. 12/121,504, filed on May 15, 2008, which assigned to the present assignee and herein incorporated by reference in its entirety. Additionally, the material may be formable or moldable, similar to clay, which may allow for the material to be shaped to have the desired thickness, shape, contour, etc., when placed or positioned in a mold. Further, as a result of the structural cohesiveness, when placed in a mold, the material may hold in place without encroaching the opposing portion of the mold cavity. In general, the stickness and/or tackiness of a material may be modified based on the relative amounts of adhesives, solvents, and platiciziers included as a temporary binder.

Referring back to FIG. 4B and C, for example, such bit (shown as 310 in FIG. 3) may be formed by stacking preformed inserts 336 within a mold corresponding to the desired location (either leading portion 332 or trailing portion 334). Optionally, an adhesive may be used to "stick" the inserts in the desired location of the mold while assembling remainder of mold. The remainder of the rib portion may then be "packed" with a premix of diamond and carbide paste, and infiltration may occur.

Advantageously, embodiments of the present disclosure for at least one of the following. By providing a bit with differing materials on a leading and trailing portion of a rib, a bit may provided to drill through formations of specific hardnesses and/or may make a bit particularly suitable for drilling through a variety of formations, including mixed formations, due to the adaptive nature of the bit. Further, a trailing portion may be selected for its toughness, which may reduce blade breakage and allow the blade height to increase, which would increase the drilling life of the blade. Further, by using ribs formed of multiple materials, it may be possible to effectively drill through mixed formation types. Further, additional support and durability may be achieved where a continuous body matrix is provided between the bit body and a trailing portion of the rib.

Further, as discussed above, particular embodiments may use preformed inserts in one of the leading or trailing portion in forming the bits of the present disclosure. Use of preformed inserts may allow for a greater degree and ease of controllability of the precise hardness and chemical content of the portions to allow for tailoring a bit to a particular application. Such controllability may result from the ability to mix the component materials (carbide, metal, and diamond) in exact ratios and consolidate (such as by hot pressing) the mixture into inserts for use in manufacturing a bit. Additionally, use of preformed inserts may allow for the use of an ultra-low amount of carbide (0-30% by weight) that may not necessarily be accomplished by traditional infiltration techniques in forming a rib due to the potential for carbide particles in ribs to pack together before liquid infiltration binder melts into the carbide skeleton. Thus, use of preformed insert may allow for greater ease in tailoring the hardness of the leading and trailing portion, for example, by adding 5 or 10 percent more binder metal powder, which may not necessarily be possible using conventional infiltration of matrix powder where limitations on the amount of binder powder for effective infiltration may exist.

In certain embodiments, a trailing portion may preferentially wear by exposing fresh diamond due to a difference in matrix materials, creating a taper on the rib, which also increases ROP. Further, the matrix material of the leading portion may be selected to be more wear resistant than the matrix material of the trailing portion in order to expose the concentrated grit at a slower rate. This may result in a robust cutting instrument wherein the grit is exposed in a controlled fashion. Further, the disparity in wear properties between multiple matrices may allow for tailoring of the some of the properties of the cutting structure such as grit concentration, wear rate, controlled exposure of encapsulated grit to the formation, cuttings removal and robustness. Superior cuttings removal properties may result from the taper, as cuttings possess more room for being swept away.

Further, in embodiments where the leading and trailing portions vary along the length of a rib, such variation may allow for tailoring of the bit depending on wear patterns seen in the field. For example, in horizontal applications, where wear is typically experienced to a greater degree in the gage (outer radial) portion of a rib, it may be desirable to have a thicker, more abrasive leading portion at the outer radial portion of the rib and thicker, softer trailing portion at the bit center, to optimize ROP and durability. Conversely, where wear is typically experienced to a greater degree in the bit center portion of a rib, it may be desirable to have a thicker, more abrasive leading portion at the bit center portion of the rib and a thicker, softer trailing portion at the outer gage portion, to optimize ROP and durability.

Additionally, for embodiments in which a variation in rib profile height is included, during initial drilling (when only taller ribs engage with the formation) ROP may increase because there is more force per cutting edge, allowing the diamond life cycle to become more rapid. Upon continued drilling, when the shorter rib begin to engage with the formation, while ROP may slow down, increased durability may be achieved. Providing two profiles may allow the bit to be put in a specific formation for with a specific profile, and as the bit drills, the profile will change from the original profile to the secondary profile (using all ribs). Thus, the secondary profile may be used to drill a harder or more abrasive formation that is deeper than the original formation that was drilled with the primary profile.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drill bit, comprising:

a matrix bit body comprising a matrix material and having a lower end face for engaging a rock formation, the end face having a plurality of raised ribs extending from the face of the bit body to an outer side surface of the bit body and separated by a plurality of channels therebetween, wherein the plurality of ribs are at least partially impregnated; and at least one of the plurality of ribs having a leading portion and a trailing portion, wherein only one of the leading portion and the trailing portion comprises the same matrix material as the bit body forming a continuous body matrix, and the other of the leading portion and the trailing portion comprises a different material.

2. The drill bit of claim 1, wherein the trailing portion of the at least one of the plurality of ribs comprises the continuous body matrix.

3. The drill bit of claim 1, wherein the leading portion or the trailing portion comprises a matrix material devoid of impregnated particles.

4. The drill bit of claim 1, wherein the leading portion or the trailing portion comprises super abrasive particles impregnated therein.

5. The drill bit of 4, wherein the super abrasive particles are selected from the group consisting of diamond, cubic boron nitride, thermally stable polycrystalline diamond, silicon carbide, aluminum oxide, tool steel, or boron carbide.

* * * * *